US005609752A

United States Patent [19]

Del Rossi et al.

[11] Patent Number: 5,609,752

[45] Date of Patent: Mar. 11, 1997

[54] PROCESS FOR CETANE IMPROVEMENT OF DISTILLATE FRACTIONS

[75] Inventors: Kenneth J. Del Rossi, Woodbury, N.J.; Gregory A. Jablonski, Yardley, Pa.; David O. Marler, Deptford, N.J.

[73] Assignee: Mobil Oil Corporation, Fairfax, Va.

[21] Appl. No.: 570,808

[22] Filed: Dec. 12, 1995

Related U.S. Application Data

[63] Continuation of Ser. No. 227,824, Apr. 14, 1994, abandoned.

[51] Int. Cl.[6] ..... C10G 45/00

[52] U.S. Cl. ..... 208/144; 585/269

[58] Field of Search ..... 585/269; 208/144

[56] References Cited

U.S. PATENT DOCUMENTS

| | | | |
|---|---|---|---|
| 4,305,808 | 12/1981 | Bowes | 208/111 |
| 4,419,220 | 12/1983 | LaPierre et al. | 208/111 |
| 4,921,595 | 1/1990 | Gruia | 208/59 |
| 4,960,505 | 10/1990 | Minderhoud et al. | 208/143 |
| 4,968,402 | 11/1990 | Kirker et al. | 208/68 |
| 4,985,134 | 5/1990 | Morrison | 585/476 |
| 4,990,239 | 1/1991 | Derr, Jr. et al. | 208/89 |
| 5,147,526 | 9/1992 | Kukes et al. | 208/111 |
| 5,346,612 | 9/1994 | Kukes et al. | 208/144 |

*Primary Examiner*—Glenn A. Caldarola
*Assistant Examiner*—Walter D. Griffin
*Attorney, Agent, or Firm*—Thomas W. Steinberg

[57] ABSTRACT

There is provided a process for increasing the Cetane Index of a distillate fraction by reacting the fraction with hydrogen over a catalyst comprising a hydrogenation component, such as platinum, and zeolite Beta. The process results in the selective ring opening of cyclic compounds, such as aromatics, with a minimum of cracking of paraffinic hydrocarbons.

10 Claims, No Drawings

PROCESS FOR CETANE IMPROVEMENT OF DISTILLATE FRACTIONS

CROSS REFERENCE TO RELATED APPLICATION

This application is a continuation of copending U.S. application Ser. No. 08/227,824, filed Apr. 14, 1994, now abandoned.

BACKGROUND

There is provided a process for increasing the Cetane Index of a distillate fraction by reacting the fraction with hydrogen over a catalyst comprising a hydrogenation component and zeolite beta.

Legislation mandating lower aromatics and increased Cetane Index (and number) of the distillate pool will have a major impact on refinery operations. Reduction of aromatics, especially particulate forming polynuclear aromatics, can be achieved by hydrocracking, hydrogenation, ring opening (decyclization), or a combination of ring opening and hydrogenation. A process utilizing a zeolite-based catalyst in conjunction with Pt for the reduction of benzene by utilizing hydrogenation and acid functionalities to hydrogenate/decyclize the benzene has previously been disclosed in Published International Application (PCT) Publication No. WO 93/08145.

In accordance with the present invention, the concept of reducing benzene is extended to the reduction of polynuclear aromatics in process streams containing high levels of polynuclear aromatics, e.g., light cycle oils, and vacuum distillates. In doing so, Cetane Index and number can be improved significantly without significant $H_2$ consumption and distillate yield loss.

Although the hydrodecyclization of mono-ring aromatics has been demonstrated previously in the above-mentioned PCT WO 93/08145, the extension of this approach to multi-ring, distillate range feeds is not trivial. Boiling point conversion (distillate yield) and $H_2$ consumption must be weighed against improvements in product properties.

Publications such as EP 512652 (May 5, 1992); EP 303332 (Aug. 11, 1988); EP 247678 (May 15, 1987); U.S. Pat. No. 5,147,526; and U.S. Pat. No. 4,921,595 suggest that USY-based catalyst systems containing Pt and/or Pd are active catalysts for upgrading Cetane Index through the conversion of distillate streams.

SUMMARY

There is provided a process for selectively increasing the cetane index of a distillate hydrocarbon fraction, said distillate hydrocarbon fraction being contained in a hydrocarbon feed to said process, said process comprising the steps of:

(a) contacting said hydrocarbon feed and hydrogen with a catalyst under reaction conditions sufficient to increase the cetane index of said distillate hydrocarbon fraction, wherein said catalyst comprises zeolite beta and at least one hydrogenation component, and (b) recovering said distillate fraction.

EMBODIMENTS

There is provided a process utilizing zeolite Beta in conjunction with a hydrogenation component, such as Group VIII metals as well as Mo, W, and Re, and combinations of these metals for the conversion of undesirable polynuclear aromatics in distillate range process streams. Particularly preferred process chemistry includes hydrogenation, or hydrogenation coupled with decyclization. The hydrogenation/decyclization of the polynuclear aromatics is accomplished without extensive hydrocracking, and with minimal boiling point conversion. As a result of the conversion of the low Cetane Index polynuclear aromatics, the Cetane Index of the resulting product is enhanced relative to the feed. In addition, a volume swell may be realized.

Data showing higher Cetane Index product formed over Pt/steamed Beta than over Pt/unsteamed Beta and NiW/USY suggest that the novel structure of zeolite Beta, especially when coupled with a higher $SiO_2/Al_2O_3$ ratio, may have advantages over other catalysts for improving Cetane Index. A relatively high $SiO_2/Al_2O_3$ ratio for zeolite Beta may be obtained via steaming or by other methods, such as by chemical dealumination or via direct synthesis techniques.

Legislation mandating aromatic reduction would require the development of catalytic processes for converting process streams, especially in the distillate range, with high aromatic content. The reduction of aromatics via hydrogenation or hydrogenation coupled with decyclization offers the promise of aromatic reduction as well as improved Cetane Index for distillate range materials.

Particular conditions for use in the present process are described in the aforementioned U.S. Pat. No. 5,147,526. The hydrocarbon feedstock processed may consist essentially of any one, several, or all refinery streams boiling in a range from about 150° F. to about 700° F., preferably 300° F. to about 700° F., and more preferably between about 350° F. and about 700° F., at atmospheric pressure. For the purpose of the present invention, the term "consisting essentially of" is defined as at least 95% of the feedstock by volume. The lighter hydrocarbon components in the distillate product are generally more profitably recovered as gasoline, and the presence of these lower boiling materials in distillate fuels is often constrained by distillate fuel flash point specifications. Heavier hydrocarbon components boiling above 700° F. are generally more profitably (1) processed into lubricants or (2) processed as FCC feed and converted to gasoline. The presence of heavy hydrocarbon components in distillate fuels is further constrained by distillate fuel end point specifications.

The distillate fraction in the hydrocarbon feedstock may have an initial boiling point of at least 204° C. The distillate fraction in the hydrocarbon feedstock may comprise at least 80% by volume of the hydrocarbon feedstock. The volume of the distillate fraction recovered may be at least 80% of the volume of the distillate fraction contained in the hydrocarbon feedstock.

The hydrocarbon feedstock can comprise high and low sulfur virgin distillates derived from high- and low-sulfur crudes, coker distillates, catalytic cracker light and heavy catalytic cycle oils, and distillate boiling range products from hydrocracker and resid hydrotreater facilities. Generally, coker distillate and the light and heavy catalytic cycle oils are the most highly aromatic feedstock components, ranging as high as 80% by weight (FIA). The majority of coker distillate and cycle oil aromatics are present as monoaromatics and diaromatics with a smaller portion present as triaromatics. Virgin stocks such as high and low sulfur virgin distillates are lower in aromatics content ranging as high as 20% by weight aromatics (FIA). Generally, the aromatics content of a combined hydrogenation facility feedstock will range from about 5% by weight to about 80% by weight, more typically from about 10% by weight to about 70% by weight, and most typically from about 20% by weight to about 60% by weight. In particular, the hydrocarbon feed may have an aromatics content of at least 30 wt. %. In a distillate hydrogenation facility with limited operating capacity, it is generally profitable to process feedstocks in order of highest aromaticity, since catalytic processes often proceed to equilibrium product aromatics concentrations at sufficient space velocity. In this manner, maximum distillate pool dearomatization is generally achieved.

The hydrocarbon feedstock sulfur concentration is generally a function of the high and low sulfur crude mix, the hydrogenation capacity of a refinery per barrel of crude capacity, and the alternative dispositions of distillate hydrogenation feedstock components. The higher sulfur distillate feedstock components are generally virgin distillates derived from high sulfur crude, coker distillate, and catalytic cycle oils from fluid catalytic cracking units processing relatively higher sulfur feedstocks. These feedstock components can range as high as 2% by weight elemental sulfur but generally range from about 0.1% by weight to about 0.9% by weight elemental sulfur. Where a hydrogenation facility is a two-stage process having a first-stage denitrogenation and desulfurization zone a second-stage dearomatization zone, the dearomatization zone feedstock sulfur content can range from about 100 ppm to about 0.9% by weight or as low as from about 10 ppm to about 0.9% by weight elemental sulfur.

The hydrocarbon feedstock nitrogen content is also generally a function of the nitrogen content of the crude oil, the hydrogenation capacity of a refinery per barrel of the crude capacity, and the alternative dispositions of hydrogenation feedstock components. The higher nitrogen feedstocks are generally coker distillate and the catalytic cycle oils. These feedstock components can have total nitrogen concentrations ranging as high as 2,000 ppm, but generally range from about 5 ppm to about 900 ppm.

Where the particular hydrogenation facility is a two-stage process, the first stage is often designed to desulfurize and denitrogenate, and the second stage is designed to dearomatize. In these operations, the feedstocks entering the dearomatization stage are substantially lower in nitrogen and sulfur content and can be lower in aromatics content than the feedstocks entering the hydrogenation facility.

The present hydrogenation process generally begins with a distillate feedstock preheating step. The feedstock is preheated in feed/effluent heat exchangers prior to entering a furnace for final preheating to a targeted reaction zone inlet temperature. The feedstock can be contacted with a hydrogen stream prior to, during, and/or after preheating. The hydrogen-containing stream can also be added in the hydrogenation reaction zone of a single-stage hydrogenation process or in either the first or second stage of a two-stage hydrogenation process.

The hydrogen stream can be pure hydrogen or can be in admixture with diluents such as hydrocarbon, carbon monoxide, carbon dioxide, nitrogen, water, sulfur compounds, and the like. The hydrogen stream purity should be at least about 50% by volume hydrogen, preferably at least about 75% by volume hydrogen for best results. Hydrogen can be supplied from a hydrogen plant, a catalytic reforming facility, or other hydrogen-producing processes.

The reaction zone can consist of one or more fixed-bed reactors containing the same or different catalysts. Two-stage processes can be designed with a least one fixed-bed reactor for desulfurization and denitrogenation, and at least one fixed-bed reactor for dearomatization. A fixed-bed reactor can also comprise a plurality of catalyst beds. The plurality of catalyst beds in a single, fixed-bed reactor can also comprise the same or different catalysts. Where the catalysts are different in a multi-bed, fixed-bed reactor, the initial bed or beds are generally for desulfurization and denitrogenation, and subsequent beds are for dearomatization.

Since the hydrogenation reaction is generally exothermic, interstage cooling, consisting of heat transfer devices between fixed-bed reactors or between catalyst beds in the same reactor shell, can be employed. At least a portion of the heat generated from the hydrogenation process can often be profitably recovered for use in the hydrogenation process. Where this heat recovery option is not available, cooling may be performed through cooling utilities such as cooling water or air, or through use of a hydrogen quench stream injected directly into the reactors. Two-stage processes can provide reduced temperature exotherm per reactor shell and better hydrogenation reactor temperature control.

The reaction zone effluent is generally cooled and the effluent stream is directed to a separator device to remove the hydrogen. Some of the recovered hydrogen can be recycled back to the process while some of the hydrogen can be purged to external systems such as plant or refinery fuel. The hydrogen purge rate is often controlled to maintain a minimum hydrogen purity and remove hydrogen sulfide. Recycled hydrogen is generally compressed, supplemented with "make-up" hydrogen, and reinjected into the process for further hydrogenation.

The separator device liquid effluent can then be processed in a stripper device where light hydrocarbons can be removed and directed to more appropriate hydrocarbon pools. The stripper liquid effluent product is then generally conveyed to blending facilities for production of finished distillate products.

Operating conditions to be used in the hydrogenation process include an average reaction zone temperature of from about 400° F. (204° C.) to about 750° F. (399° C.), preferably from about 450° F. (232° C.) to about 725° F. (385° C.), and most preferably from about 550° F. (288° C.) to about 650° F. (343° C.) for best results. Reaction temperatures below these ranges can result in less effective hydrogenation. Excessively high temperature can cause the process to reach a thermodynamic aromatic reduction limit, hydrocracking, catalyst deactivation, and increased energy costs. Desulfurization, in accordance with the process of the present invention, can be less affected by reaction zone temperature than prior art processes, especially at feed sulfur levels below 500 ppm, such as in the second-stage dearomatization zone of a two-stage process.

The process generally operates at reaction zone pressures ranging from about 200 psig to about 2,500 psig, more preferably from about 400 psig to about 2,500 psig, and most preferably from about 600 psig to about 1,500 psig for best results. Hydrogen circulation rates generally range from about 500 SCF/Bbl to about 20,000 SCF/Bbl, preferably from about 1,500 SCF/Bbl to about 15,000 SCF/Bbl, and most preferably from about 2,500 SCF/Bbl to about 13,000 SCF/Bbl for best results. Reaction pressures and hydrogen circulation rates below these ranges can result in higher catalyst deactivation rates resulting in less effective desulfurization, denitrogenation, and dearomatization. Excessively high reaction pressures increase energy and equipment costs and provide diminishing marginal benefits.

The process generally operates at a liquid hourly space velocity (LHSV) of from about 0.1 $hr^{-1}$ to about 10.0 $hr^{-1}$, preferably from about 0.2 $hr^{-1}$ to about 5.0 $hr^{-1}$, and most preferably from about 0.5 $hr^{-1}$ to about 2.0 $hr^{-1}$ for best results. Excessively high space velocities will result in reduced overall hydrogenation.

Dearomatization performance is generally measured by the percentage of aromatics saturated, calculated as the weight percentage of aromatics in the hydrogenation process product subtracted from the weight percentage of aromatics in the feedstock divided by the weight percentage of aromatics in the feedstock. The present hydrogenation process can generally attain and sustain aromatics saturation levels of greater than 20%, greater than 50%, and as high as or higher than 80%. This high level of aromatics saturation provides for a hydrogenation process that can operate at less severe and costly operating conditions, prolonging catalyst life.

The present hydrogenation process provides outstanding desulfurization and denitrogenation performance. The hydrogenation process can generally attain product sulfur levels below 100 ppm, below 90 ppm, and below 50 ppm. The hydrogenation process can generally attain product nitrogen levels below 5 ppm, below 3 ppm, and as law as 1 ppm. This level of desulfurization and denitrogenation can result in a reduction in first-stage hydrorefining catalyst requirements, increase the attractiveness of using desulfurized distillate to blend down plant fuel sulfur levels for $SO_2$ environmental compliance, and increase the attractiveness of catalytically cracking desulfurized distillates.

The present hydrogenation process provides a substantial increase in distillate product cetane number. Higher fluid catalytic cracking severity has resulted in FCC distillate products having lower cetane numbers, adding certain limitations in refinery distillate pools that previously may not have existed. The hydrogenation process can generally achieve product cetane number improvements of over 5 numbers, over 6 numbers, and as high as 10 numbers. Improved cetane production can reduce costly cetane improver additive requirements and increase premium (high cetane) distillate production capacity.

The present hydrogenation process may provide substantial distillate volume expansion. Distillate volume expansion is generally measured by the reduction in specific gravity across the hydrogenation process and is calculated as the specific gravity of the hydrogenation process product subtracted from the specific gravity of the feedstock divided by the specific gravity of the feedstock. The hydrogenation process can expand the volume of the distillate feedstock by more than 2.4%, more than 3.0%, and more than 4.4%. Volume expansion across a distillate hydrogenation process can permit petroleum refiners to meet customer distillate demands at incrementally lower crude run.

The catalyst used in the present process comprises zeolite Beta and a hydrogenating component. Zeolite Beta is a known zeolite which is described in U.S. Patent Nos. 3,308,069 and Re. 28,341, to which reference is made for further details of this zeolite, its preparation, and properties. The composition of zeolite Beta is its as-synthesized for may be as follows, on an anhydrous basis:

$$[XNa(1.0\pm0.1-X)TEA]AlO_2.YSiO_2$$

where X is less than 1, preferably less than 0.75; TEA represents the tetraethylammonium ion; Y is greater than 5 but less than 100. In the as-synthesized form, water of hydration may also be present in ranging amounts.

The sodium is derived from the synthesis mixture used to prepare the zeolite. This synthesis mixture contains a mixture of the oxides (or of materials whose chemical compositions can be completely represented as mixtures of the oxides) $Na_2O$, $Al_2O_3$, $[(C_2H_5)_4N]_2$, $SiO_2$, and $H_2O$. The mixture may be held at a temperature of about 75° C. to 200° C. until crystallization occurs. The composition of the reaction mixture expressed in terms of mol ratios preferably falls within the following ranges:

| | |
|---|---|
| $SiO_2/Al_2O_3$ | 10 to 200 |
| $Na_2O$/tetraethylammonium hydroxide (TEAOH) | 0.0 to 0.1 |
| TEAOH/$SiO_2$ | 0.1 to 1.0 |
| $H_2O$/TEAOH | 20 to 75 |

The product which crystallizes from the hot reaction mixture is separated, suitably by centrifuging or filtration, washed with water and dried. The material so obtained may be calcined by heating in air or an inert atmosphere at a temperature usually within the range 200° C. to 900° C. or higher. This calcination degrades the tetraethylammonium ions to hydrogen ions and removes the water so that N in the formula above becomes zero or substantially so. The formula of the zeolite is then:

$$[XNa(1.0\pm0.1-X)H]AlO_2.\ YSiO_2$$

where X and Y have the values ascribed to them above. The degree of hydration is here assumed to be zero, following the calcination.

If this H-form zeolite is subjected to base exchange, the sodium may be replaced by another cation to give a zeolite of the formula (anhydrous basis):

$$[(x/n)M(1\pm0.1-X)H].AlO_2.YSiO_2$$

where X and Y have the values ascribed to them above and n is the valence of the metal M which may be any metal but is preferably a metal of Groups IA, IIA, or IIA of the Periodic Table or a transition metal (the Periodic Table referred to in this specification is the table approved by IUPAC and the U.S. National Bureau of Standards shown, for example, in the Table of Fisher Scientific Company, Catalog No. 5-702-10).

The as-synthesized sodium form of the zeolite may be subjected to base exchange directly without intermediate calcination to give a material of the formula (anhydrous basis):

$$[(x/n)M(1\pm0.1-X)TEA]AlO_2.YSiO_2$$

where X, Y, n, and m are as described above. This form of the zeolite may then be converted partly to the hydrogen form by calcination, e.g., at 200° C. to 900° C. or higher. The completely hydrogen form may be made by ammonium exchange followed by calcination in air or an inert atmosphere such as nitrogen. Base exchange may be carried out in the manner disclosed in U.S. Pat. Nos. 3,308,069 and Re. 28,341.

When tetraethylammonium hydroxide is used in its preparation, zeolite Beta may contain occluded tetraethylammonium ions (e.g., as the hydroxide or silicate) within its pores in addition to that required by electroneutrality and indicated in the calculated formulae given in this specification. The formulae, of course, are calculated using one equivalent of required cation per Al atom in tetrahedral coordination in the crystal lattice.

Zeolite Beta, in addition to possessing a composition as defined above, may also be characterized by its X-ray diffraction data which are set out in U.S. Pat. Nos. 3,308,069 and Re. 28,341. The significant d values (Angstroms, radiation: K alpha doublet of copper, Geiger counter spectrometer) are as shown in Table 1 below:

TABLE 1

| d Values of Reflections in Zeolite Beta |
|---|
| 11.40 ± 0.2 |
| 7.40 ± 0.2 |
| 6.70 ± 0.2 |
| 4.25 ± 0.1 |
| 3.97 ± 0.1 |
| 3.00 ± 0.1 |
| 2.20 ± 0.1 |

The preferred forms of zeolite Beta for use in the present process are the high silica forms, having a silica: alumina molar ratio of at least 30:1. Zeolite Beta may be prepared with silica:alumina molar ratios above the 100:1 maximum specified in U.S. Pat. Nos. 3,308,069 and Re. 38,341; and it is believed that these forms of the zeolite provide the best performance in the present process. Ratios of at least 50:1 and preferably at least 100:1 or even higher, e.g., 250:1, 500:1, may be used in order to maximize the aromatics conversion reactions at the expense of the cracking reactions.

The silica:alumina ratios referred to in this specification are the structural or framework ratios, that is, the ratio of the $SiO_4$ to the $AlO_4$ tetrahedra which together constitute the structure of which the zeolite is composed. It should be understood that this ratio may vary from the silica:alumina ratio determined by various physical and chemical methods. For example, a gross chemical analysis may include aluminum which is present in the form of cations associated with the acidic sites on the zeolite, thereby giving a low silica:alumina ratio. Similarly, if the ratio is determined by the TGA/$NH_3$ adsorption method, a low ammonia titration may be obtained if cationic aluminum prevents exchange of the ammonium ions onto the acidic sites. These disparities are particularly troublesome when certain treatments such as the dealuminization method described below which result in the presence of ionic aluminum free of the zeolite structure are employed. Due care should therefore be taken to ensure that the framework silica:alumina ratio is correctly determined.

The silica:alumina ratio of the zeolite may be determined by the nature of the starting materials used in its preparation and their quantities relative to one another. Some variation in the ratio may therefore be obtained by changing the relative concentration of the silica precursor relative to the alumina precursor, but definite limits in the maximum obtainable silica:alumina ratio of the zeolite may be observed. For zeolite Beta this limit is about 100:1; and for ratios above this value, other methods are usually necessary for preparing the desired high silica zeolite. One such method comprises dealumination by extraction with acid.

Briefly, the acid extraction method may comprise contacting the zeolite with an acid, preferably a mineral acid such as hydrochloric acid. The dealuminization proceeds readily at ambient and mildly elevated temperatures and occurs with minimal losses in crystallinity to form high silica forms of zeolite Beta with silica:alumina ratios of at least 100:1 with ratios of 200:1 or even higher being readily attainable.

The zeolite is conveniently used in the hydrogen form for the dealuminization process although other cationic forms may also be employed, for example, the sodium form. If these other forms are used, sufficient acid should be employed to allow for the replacement by protons of the original cations in the zeolite. The amount of zeolite in the zeolite/acid mixture should generally be from 5% to 90% by weight.

The acid may be a mineral acid, i.e., an inorganic acid or an organic acid. Typical inorganic acids which can be employed include mineral acids such as hydrochloric, sulfuric, nitric and phosphoric acids, peroxydisulfonic acid, dithionic acid, sulfamic acid, peroxymonosulfuric acid, amidodisulfonic acid, nitrosulfonic acid, chlorosulfuric acid, pyrosulfuric acid, and nitrous acid. Representative organic acids which may be used include formic acid, trichloroacetic acid, and trifluoroacetic acid.

The concentration of added acid should be such as not to lower the pH of the reaction mixture to an undesirably low level which could affect the crystallinity of the zeolite undergoing treatment. The acidity which the zeolite can tolerate will depend, at least in part, upon the silica/alumina ratio of the starting material. Generally, it has been found that zeolite Beta can withstand concentrated acid without undue loss in crystallinity; but, as a general guide, the acid will be from 0.1N to 4.0N, usually 1 to 2N. These values hold good regardless of the silica:alumina ratio of the zeolite Beta starting material. Stronger acids tend to effect a relatively greater degree of aluminum removal than weaker acids.

The dealuminization reaction proceeds readily at ambient temperatures, but mildly elevated temperatures may be employed, e.g., up to 100° C. The duration of the extraction will affect the silica:alumina ratio of the product since extraction is time dependent. However, because the zeolite becomes more stable as the aluminum is removed, higher temperatures and more concentrated acids may be used towards the end of the treatment than at the beginning without the attendant risk of losing crystallinity.

After the extraction treatment, the product is water washed free of impurities, preferably with distilled water, until the effluent wash water has a pH within the approximate range of 5 to 8.

The crystalline dealuminized products obtained by the method of this invention have substantially the same crystallographic structure as that of the starting aluminosilicate zeolite but with increased silica:alumina ratios. The formula of the dealuminized zeolite Beta may therefore be, on an anhydrous basis:

$$[(x/n)M(1.0\pm0.1-X)H]AlO_2.YSiO_2$$

where X is less than 1, preferably less than 0.75; Y is at least 100, preferably at least 150; and M is a metal, preferably a transition metal or a metal of Groups IA, 2A, or A, or a mixture of metals. The silica:alumina ratio, Y, will generally be in the range of 100:1 to 500:1, more usually 50:1 to 300:3, e.g., 200:1 or more. The X-ray diffraction pattern of the dealuminized zeolite will be substantially the same as that of the original zeolite, as set out in Table 1 above. Water of hydration may also be present in varying amounts.

If desired, the zeolite may be steamed prior to acid extraction to increase the silica:alumina ratio and to render the zeolite more stable to the acid. The steaming may also serve to increase the ease with which the aluminum is removed and to promote the retention of crystallinity during the extraction process. Steaming alone, e.g., without acid extraction, is also an acceptable means of dealumination.

The zeolite is associated with a hydrogenation component which may be a noble metal such as platinum, palladium, or another member of the platinum group such as rhodium.

Combinations of noble metals such as platinum-rhenium, platinum-palladium, platinum-iridium, or platinum-iridium-rhenium together with combinations with non-noble metals, particularly of Groups VIA and VIIIA are of interest, particularly with metals such as cobalt, nickel, vanadium, tungsten, titanium, and molybdenum, for example, platinum-tungsten, platinum-nickel, or platinum-nickel-tungsten.

The metal may be incorporated into the catalyst by any suitable method such as impregnation or exchange onto the zeolite. The metal may be incorporated in the form of a cationic, anionic, or neutral complex such as $Pt(NH_3)_4^{2+}$ and cationic complexes of this type will be found convenient for exchanging metals onto the zeolite. Anionic complexes such as the vanadate or metatungstate ions are useful for impregnating metals into the zeolites.

The amount of the hydrogenation-dehydrogenation component is suitably from 0.01 to 10% by weight, normally 0.1 to 5% by weight, although this will, of course, vary with the nature of the component, less of the highly active noble metals, particularly platinum, being required than of the less active base metals.

Base metal hydrogenation components such as cobalt, nickel, molybdenum, and tungsten may be subjected to a presulfiding treatment with a sulfur-containing gas such as hydrogen sulfide in order to convert the oxide forms of the metal to the corresponding sulfides.

It may be desirable to incorporate the catalyst in another material resistant to the temperature and other conditions employed in the process. Such matrix materials include synthetic or natural substances as well as inorganic materials such as clay, silica, and/or metal oxides. The latter may be either naturally occurring or in the form of gelatinous precipitates or gels including mixtures of silica and metal oxides. Naturally occurring clays which can be composited with the catalyst include those of the montmorillonite and kaolin families. These clays can be used in the raw state as originally mined or initially subjected to calcination, acid treatment, or chemical modification.

The catalyst may be composited with a porous matrix material, such as alumina, silica-alumina, silica-magnesia, silica-zirconia, silica-thoria, silica-berylia, silica-titania, as well as ternary compositions, such as silica-aluminia-thoria, silica-alumina-zirconia, silica-alumina-magnesia, and silica-magnesia-zirconia. The matrix may be in the form of a cogel with the zeolite. The relative proportions of zeolite component and inorganic oxide gel matrix may vary widely with the zeolite content ranging from between 1 to 99, more usually 5 to 80, percent by weight of the composite. The matrix may itself possess catalytic properties, generally of an acidic nature.

EXAMPLE

A fixed-bed reactor was utilized to evaluate Pt/steamed Beta for the conversion of a hydrotreated refinery stream (70% light cycle oil, 30% straight run gas oil). Properties of the feed are listed in Table 2, and properties of the catalyst are listed in Table 3.

TABLE 2

| Feed Properties | |
|---|---|
| Composition | |
| % LCO | 70 |
| % SRG | 30 |
| Gravity, °API | 31.2 |
| Nitrogen | <1 ppm |
| Sulfur | <20 ppm |
| Aromatics | 38 wt. % |
| Cetane Index (400° F.+) | 47.5 |
| Distillation, % | Temperature, °F. |
| IBP | 283 |
| 20 | 415 |
| 40 | 461 |
| 60 | 507 |
| 80 | 567 |
| End Point | 733 |

TABLE 3

| Catalyst Properties-Pt/Beta | |
|---|---|
| Zeolite loading | 65 wt. % |
| Binder | $Al_2O_3$ |
| Surface Area | 385 $m^2/g$ |
| Pt Loading | 0.6 wt. % |
| Density | 2.6 g/cc |

In the evaluation of Pt/steamed Beta, the reactor was operated at pressures between 200 and 2000 psig, temperatures between 340° F. and 700° F., $H_2$ co-feed rates between 1700 and 11,500 scfb, and feed rates of 0.5 to 5 LHSV. After the catalyst was loaded into the reactor, the catalyst was reduced in $H_2$ at 200° C. After this reduction step, the catalyst was sulfided using a mixture of 2 vol. % $H_2S$ in $H_2$. A maximum sulfiding temperature of 315° C. was utilized. Following the completion of catalyst sulfiding, the feed was introduced.

The results of the conversion of the hydrotreated feed are shown in Table 4. At 400° F.+ conversion levels between 5 and 10%, Cetane Index improvements relative to the feed of 6 numbers (53 versus 47) were obtained with greater than 80 wt. % distillate yield. Table 4 shows that at similar 400° F.+ conversion levels (distillate yield), the Cetane Index improvement relative to the feed obtained over Pt/steamed Beta is 3–4 numbers greater than that obtained over NiW/USY, a commercial hydrocracking catalyst (Criterion Z753), and 4–5 numbers greater than over Pt/unsteamed Beta.

TABLE 4

Process Conditions and Product Selectivities Obtained over Pt/Beta and NiW/USY

| Catalyst | Temp., °F. | Pressure, psig | LHSV $hr^{-1}$ | $H_2$ Rate, scfb feed | 400° F. Conversion | 400° F.+ Distillate Yield | 400° F.+ Cetane Index |
|---|---|---|---|---|---|---|---|
| Pt/Beta | 500 | 1260 | 0.5 | 5500 | 3.6 | 87.4 | 54.5 |
| | 500 | 1000 | 2.2 | 5500 | 5.3 | 85.6 | 54.5 |

TABLE 4-continued

Process Conditions and Product Selectivities Obtained over Pt/Beta and NiW/USY

| Catalyst | Temp., °F. | Pressure, psig | LHSV $hr^{-1}$ | $H_2$ Rate, scfb feed | 400° F. Conversion | 400° F.+ Distillate Yield | 400° F.+ Cetane Index |
|---|---|---|---|---|---|---|---|
| | 660 | 890 | 1.4 | 10200 | 9.4 | 81.0 | 54.0 |
| Pt/unsteamed | 461 | 500 | 2.5 | 3080 | 9.0 | 82.6 | 48.7 |
| Beta | 456 | 900 | 2.5 | 3100 | 10.2 | 81.4 | 49.5 |
| | 449 | 900 | 1 | 6900 | 13.5 | 78.4 | 50.8 |
| NiW/USY | 500 | 1100 | 1.8 | 2730 | 6.3 | 84.8 | 49.7 |
| | 500 | 200 | 1.8 | 2730 | 3.5 | 87.5 | 49.2 |
| | 550 | 980 | 3.3 | 1500 | 8.5 | 82.8 | 51.2 |

What is claimed is:

1. A process for selectively increasing the Cetane Index of a distillate hydrocarbon fraction, said distillate hydrocarbon fraction being contained in a hydrocarbon feed to said process, said process comprising the steps of:

(a) contacting said hydrocarbon feed and hydrogen with a catalyst under reaction conditions sufficient to increase the Cetane Index of said distillate hydrocarbon fraction, wherein said catalyst comprises zeolite Beta and at least one hydrogenation component, wherein said zeolite Beta has a silica to alumina molar ratio of at least 250, and (b) recovering said distillate fraction.

2. A process according to claim 1, wherein said distillate fraction has an initial boiling point of 204° C., wherein said distillate fraction comprises at least 80% by volume of said hydrocarbon feed, and wherein the volume of said distillate fraction recovered in step (b) is at least 80% of the volume of said distillate fraction contained in the hydrocarbon feed to step (a).

3. A process according to claim 1, wherein said hydrogenation component comprises at least one metal selected from the group consisting of Group VIII metals, rare earth metals, Mo and W.

4. A process according to claim 1, wherein said zeolite Beta has been steamed.

5. A process according to claim 3, wherein said hydrogenation component comprises Pt.

6. A process according to claim 1, wherein said hydrocarbon feed has an aromatics content of at least 30 wt %.

7. A process according to claim 1, wherein the volume of the distillate fraction recovered is greater than the volume of the distillate fraction in the hydrocarbon feed.

8. A process according to claim 1, wherein said hydrocarbon feed is selected from the group consisting of light cycle oils, gas oils, vacuum distillates and mixtures of these feeds.

9. A process according to claim 3, wherein said hydrogenation component is impregnated or exchanged onto the catalyst comprising the hydrogen form of said zeolite beta.

10. A process according to claim 1, wherein said reaction conditions in step (a) include a pressure of from about 200 psig to about 2,500 psig, a temperature of from about 232° C. to about 343° C., a hydrogen co-feed rate of from about 500 SCF/Bbl to about 20,000 SCF/Bbl, and a hydrocarbon feed rate of from about 0.1 LHSV to about 2.0 LHSV.

* * * * *

UNITED STATES PATENT AND TRADEMARK OFFICE

CERTIFICATE OF CORRECTION

PATENT NO. : 5,609,752

DATED : March 11, 1997

INVENTOR(S) : Kenneth J. Del Rossi, et al.

It is certified that error appears in the above-indentified patent and that said Letters Patent is hereby corrected as shown below:

In Claim 1, column 11, line 26, after "Beta", insert --"has been steamed and wherein said zeolite Beta"--

Delete Claim 4, column 12, lines 16-17.

Signed and Sealed this

Second Day of December, 1997

*Attest:*

*Attesting Officer*

Bruce Lehman

BRUCE LEHMAN

*Commissioner of Patents and Trademarks*